US009969202B1

(12) United States Patent
DaDante

(10) Patent No.: US 9,969,202 B1
(45) Date of Patent: May 15, 2018

(54) GREETING CARD WITH GIFT CARD HOLDER

(71) Applicant: American Greetings Corporation, Cleveland, OH (US)

(72) Inventor: Jennifer DaDante, North Ridgeville, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days. days.

(21) Appl. No.: 15/789,097

(22) Filed: Oct. 20, 2017

(51) Int. Cl.

| | |
|---|---|
| ***G09F 1/00*** | (2006.01) |
| ***B42D 15/02*** | (2006.01) |
| ***B42D 15/04*** | (2006.01) |
| ***G09F 1/04*** | (2006.01) |

(52) U.S. Cl.
CPC ..... *B42D 15/022* (2013.01); *B42D 15/045* (2013.01); *G09F 1/04* (2013.01)

(58) Field of Classification Search
CPC ..... B42D 15/045; B42D 15/0073; B42D 15/008; B42D 15/042; B42D 25/285
See application file for complete search history.

(56) References Cited

U.S. PATENT DOCUMENTS

| | | | | |
|---|---|---|---|---|
| D317,623 | S | 6/1991 | Piechocki | |
| 6,153,311 | A | 11/2000 | Springer et al. | |
| D642,613 | S | 8/2011 | McClain et al. | |
| D719,834 | S | 12/2014 | Mayer | |
| D764,582 | S | 8/2016 | Higgins et al. | |
| D765,169 | S | 8/2016 | Deckerd et al. | |
| 9,412,104 | B2 | 8/2016 | Rider et al. | |
| D781,957 | S | 3/2017 | Higgins | |
| 9,597,916 | B2 * | 3/2017 | Begin | B42D 15/022 |
| 2013/0186783 | A1 | 7/2013 | Glass et al. | |
| 2015/0197117 | A1 * | 7/2015 | Begin | B42D 15/022 40/125.03 |

* cited by examiner

*Primary Examiner* — Shin H Kim
(74) *Attorney, Agent, or Firm* — Christine Flanagan

(57) ABSTRACT

A combined greeting card and gift card holder which also includes audio capability and motor movement of at least one mobile object attached to or integral with the greeting card. The greeting card may additionally contain certain embellishments such as faux fur to make the greeting card more appealing and entertaining.

20 Claims, 5 Drawing Sheets

GREETING CARD WITH GIFT CARD HOLDER

RELATED APPLICATIONS

There are no applications related to this application.

FIELD OF THE INVENTION

This invention is in the field of social expression products and more specifically to a greeting card with integral gift card holder.

SUMMARY OF THE INVENTION

A combined greeting card and gift card holder having a greeting card body with one or more cavities therein, a motor module contained within the one or more cavities in the greeting card body, a mobile object attached to the greeting card body, a flap contained on the greeting card body, the flap operative to move between a first or closed position and a second or open position, a gift card holder contain within the one or more cavities in the greeting card body and beneath the flap, a switch which controls activation of the motor module, the switch attached to the gift card holder, wherein opening the flap reveals the gift card holder and activates the motor module causing movement of the mobile object.

A greeting card having a greeting card body having one or more hidden compartments therein, a gift card holder contained within the one or more hidden compartments in the greeting card body, a flap contained on the greeting card body over the gift card holder, a sound module contained within the one or more hidden compartments in the greeting card body, the sound module operative to store and playback at least one audio file, a motor module contained within the one or more hidden compartments in the greeting card body, the motor module operative to cause movement of a mobile object, wherein opening the flap activates the sound module causing playback of the at least one audio file, activates the motor module causing movement of the mobile object and also reveals the gift card holder.

A combined greeting card and gift card holder having a greeting card body having one or more hidden compartments therein, a flap contained on the greeting card body, the flap operative to move between an open position and a closed position, a gift card holder contained within the one or more hidden compartments in the greeting card body and visible when the flap is in the open position, a motor module contained within the one or more hidden compartments in the greeting card body, wherein moving the flap from the closed position to the open position initiates the motor module causing movement of a mobile object connected to the greeting card body.

DETAILED DESCRIPTION OF PREFERRED AND ALTERNATE EMBODIMENTS

Figure 1:
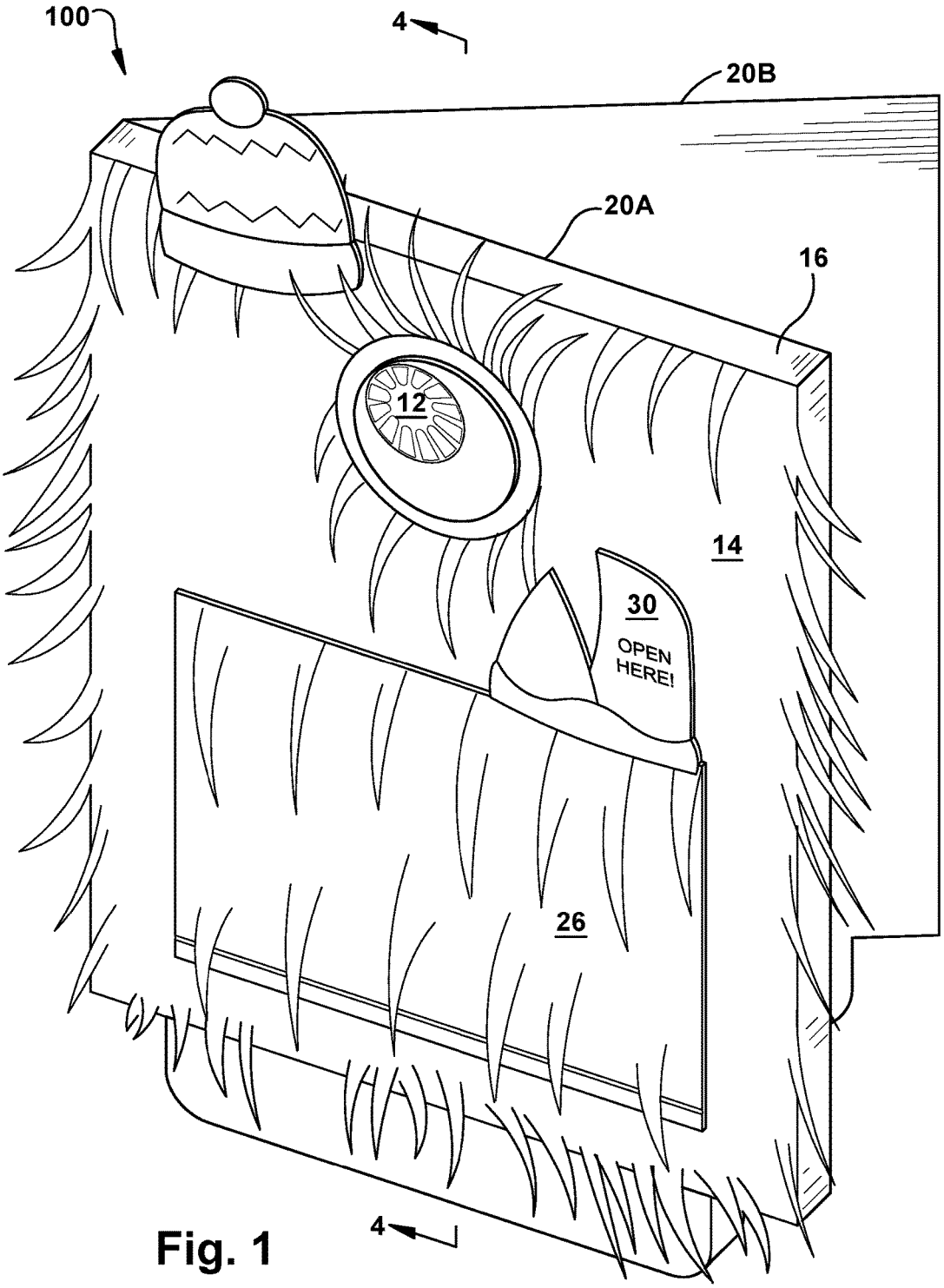
FIG. 1 is a perspective view of the Greeting Card with Gift Card Holder of the present invention, with gift card holder in a closed position.

An embodiment of the present invention is a combined greeting card and gift card holder 100 which also includes audio capability and motor movement of at least one mobile object 12 attached to or integral with the greeting card. The greeting card/gift card holder combination may additionally contain certain embellishments such as faux fur 14 to make the greeting card more appealing and entertaining.

The term "greeting card" as used in this specification, is intended to refer to the combined greeting card and gift card holder of the present invention. The body of the greeting card, in one embodiment, includes a foam core 16 (or other such material including, but not limited, to plastic, etc.) which may be covered by one or more pieces of sheet material such as, for example, paperboard. While the term "foam core" is used herein to describe an embodiment of the invention, the term is intended to include other types of material as well. The foam core 16 contains a front surface and a rear surface opposite the front surface and a perimeter surface therebetween which substantially defines the thickness of the greeting card. The foam core 16 may be shaped to resemble a person, character, or any other animate or inanimate object. The foam core 16 may also contain one or more openings or compartments within the foam (or other such material). In one embodiment, as shown in the figures, the foam core 16 is shaped like a monster having a substantially rectangular body with a winter (or other type of) hat extending thereabove. A first sheet material 19 is attached to the front surface of the foam core 16 and a second sheet material 20 is attached to the rear surface thereof. The second sheet material 20 may contain two panels (a first panel 20A and a second panel 20B) which are attached along a bisecting fold line. The two panels of the second sheet material may be identically sized and shapes or may have different heights, widths and shapes. The outer surface of the first panel of the second sheet material 20A is attached directly to the rear surface of the foam core 16 and the second panel of the second sheet material 20B is folded along the fold line to lie directly beneath the first panel 20A. The second sheet material 20 can serve as a sentiment panel providing a surface onto which a user may write a personal note or sign his/her signature to the greeting card. The first 19 and second 20 sheet material attached to the front and rear surfaces of the foam core 16 may be shaped to identically match the shape of the foam core 16 for a precise attachment thereto and a neat appearance. In an alternate embodiment, the sentiment panel may not be shaped to match the shape of the foam core 16, but may have a standard rectangular shape or any other shape not consistent with the shape of the foam core 16. The perimeter of the foam core 16 located between the front and back surfaces may be left uncovered although in other embodiments, the perimeter may be covered. The first 19 and second 20 sheet material may have printing thereon which corresponds to the shape of the greeting card, such as, in one embodiment, as shown in the figures, a monster wearing a winter hat. The second sheet material 20A, 20B which is attached in part to the rear surface of the foam core may have text sentient printed thereon or artwork, photos, pictures or other printable material. The greeting card opens and closes by pivoting the second panel of the second sheet material 20B towards and away from the first panel 20A about the fold line bisecting the first and second panels of the second sheet material 20A, 20B. The front surface of the foam core (covered by the first sheet material 19) serves as the front face or cover of the greeting card. The rear surface of the foam core (covered by the front or inside surface of the first panel of the second sheet material 20A) serves as the inside left panel of the greeting card. The front or inside surface of the second panel 20B of the second sheet material 20 serves as the inside right panel of the greeting card and the back or rear surface of the second panel 20B of the second sheet material 20 serves as the back or rear panel of the greeting card. The front surface of the first sheet material 19 may be covered with faux fur 14 in keeping with the monster theme of the greeting card. The faux fur 14 may be attached to the first sheet material 19 which is attached to the front surface of the foam core 16 or it may be attached directly to the foam core 16 (omitting the first sheet material 19). The faux fur 14 may be of any color or nap and can may be made of any material. In one embodiment, the second sheet material may additionally contain faux fur thereon. In other embodiments, the first sheet material 19 or front surface of the foam core 16 may simply contain printing thereon which shows hair or other outer covering.

Figure 2:
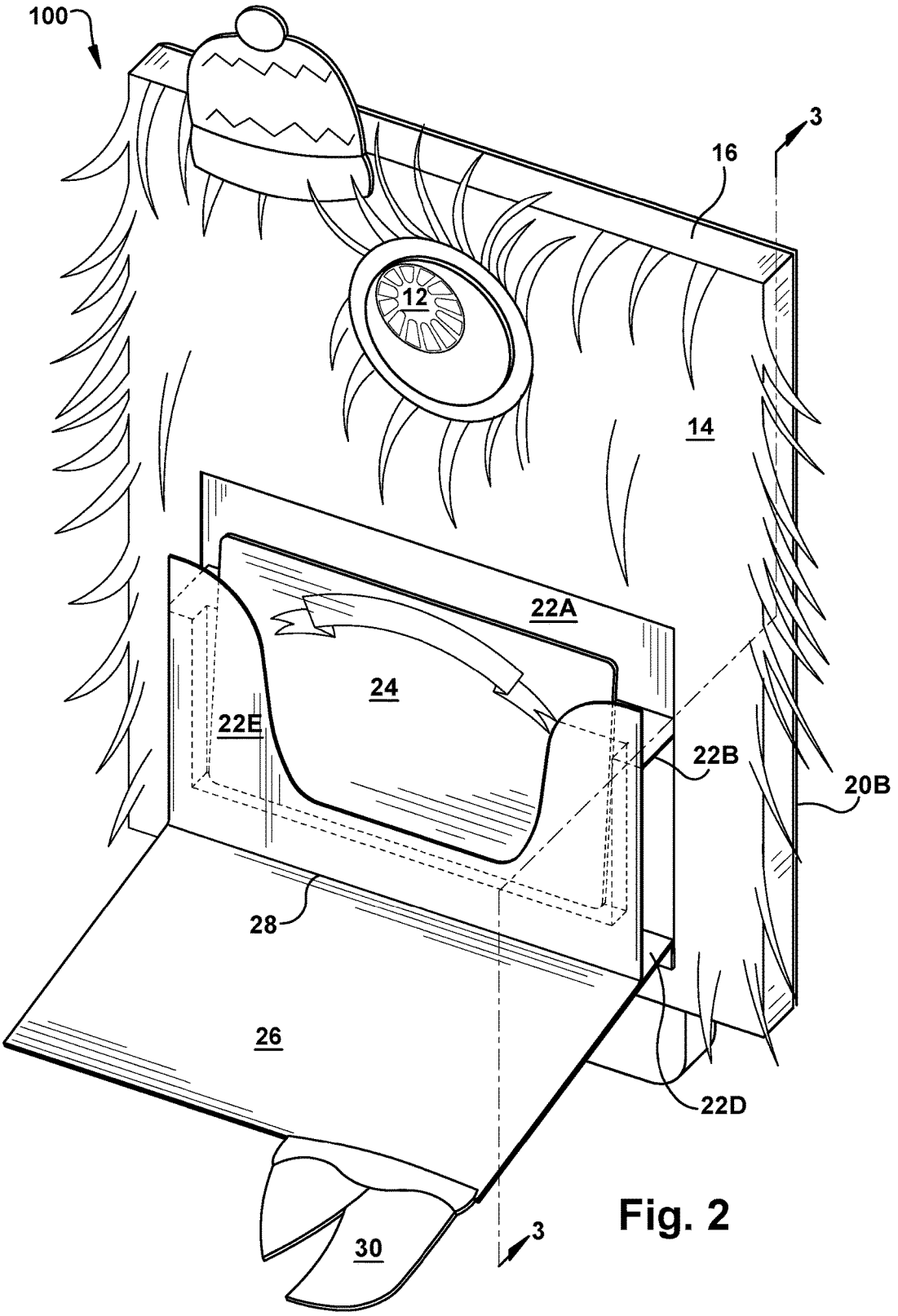
FIG. 2 is a perspective view of the Greeting Card with Gift Card Holder of FIG. 1, with gift card holder in an open position.
Figure 3:
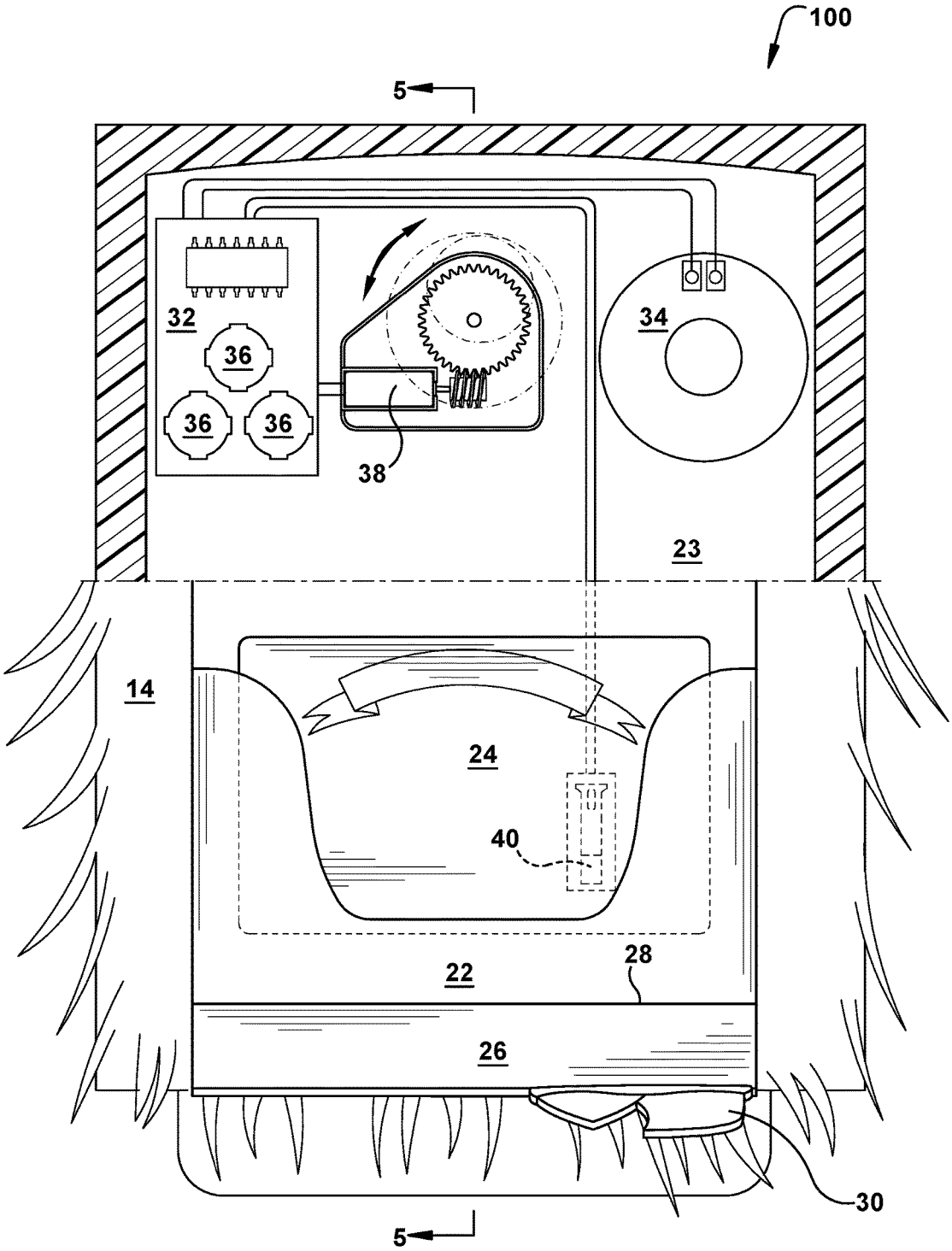
FIG. 3 is a cross-sectional view of the Greeting Card with Gift Card Holder of FIG. 2, from the perspective of arrows 3-3.
Figure 4:
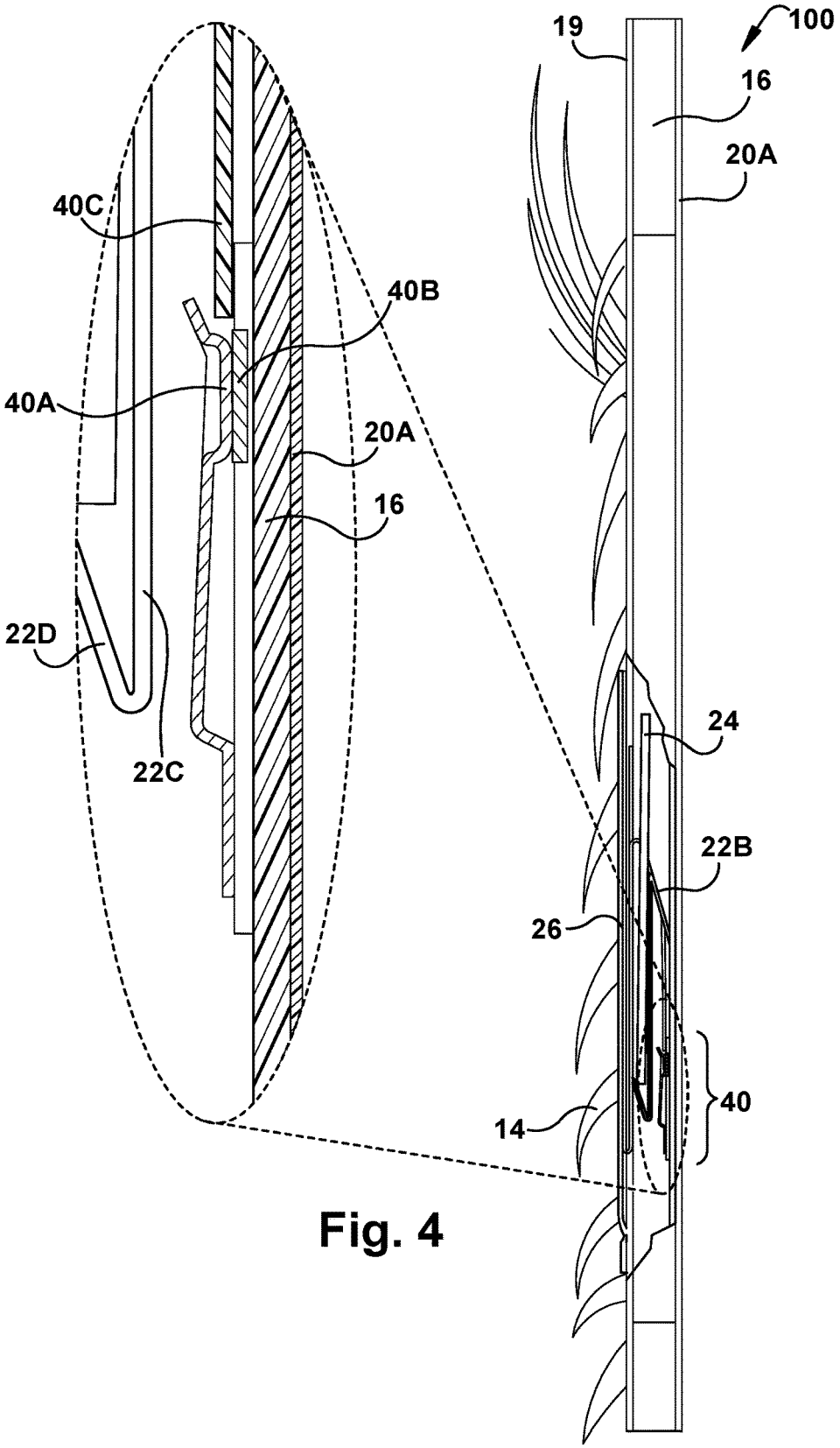
FIG. 4 is a cross-sectional view of the Greeting Card with Gift Card Holder of FIG. 1, from the perspective of arrows 4-4.
Figure 5:
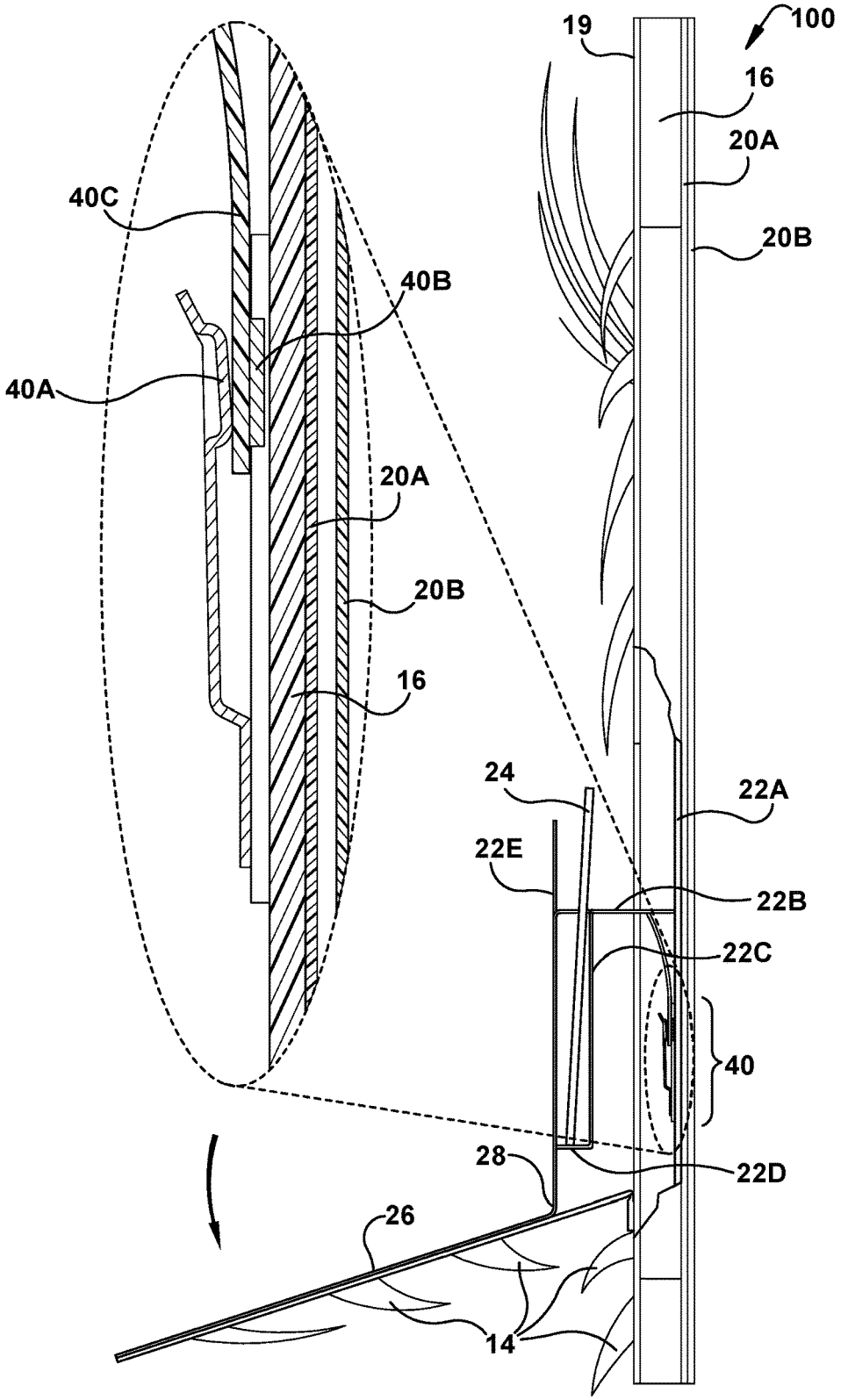
FIG. 5 is a cross-sectional view of the Greeting Card with Gift Card Holder of FIG. 2, from the perspective of arrows 5-5.

As mentioned above, the foam core 16 of the greeting card contains one or more openings therein. A gift card holder 22 is stored within the one or more openings in the foam core 16. The gift card holder 22, in one embodiment, includes a sleeve, slot, opening, pocket, or any other construct or mechanism for holding or storing a gift card 24. Three or more cuts in the front face or cover of the greeting card creates a door or flap 26 which can be opened and closed and through which the gift card holder 22 may be accessed. The door or flap 26 contains three free sides and can be opened by folding the flap or door 26 along a fourth side which is a fold or hinge line 28 in the front cover of the greeting card. In one embodiment, the fold or hinge line 28 is located at the bottom edge of the door or flap 26 such that the door or flap 26 opens outward and downward, as shown in FIGS. 2, 3 and 5. A tab 30 may be attached to a top edge (directly opposing the fold or hinge line 28) of the door or flap 26 so that a user may grasp the tab 30 and pull it in a downward direction to open the door or flap 26 to reveal the gift card holder 22. The door or flap 26 is attached to the bottom edge of the open sided pocket which serves as the gift card holder 22. The gift card holder (also referred to as "open-sided pocket" or "pocket") 22 is open along a top or upper surface thereof for insertion and removal of a gift card 24. When the door or flap 26 is opened (by pulling downward on the tab 30 or the flap 26), the pocket 22 is unfolded and revealed. The pocket 22 may contain a gift card 24 therein. The gift card 24 may extend above the front surface of the pocket 22 so that the gift card 24 is visible when the door or flap 26 is opened. The pocket 22 may also have an opening on the front face thereof so that a greater portion of the gift card 24 may be visible, as shown in FIG. 2. In one embodiment, the pocket 22 is made up of a panel which contains various fold lines and is shaped to be constructed into a receptacle into which a gift card 24 may be inserted while also being integral with the greeting card. The panel may be a single contiguous sheet or may be made of two or more pieces which are attached or connected to one another. A flat portion 22A of the panel is attached to an inside surface of the foam core 16, in one of the hidden compartments or cavities. The panel is folded into a tab 22B which is attached to and/or integral with the back or rear surface 22C of the pocket 22. The pocket 22 is attached to and/or integral with a floor 22D which is attached to and/or integral with the front surface 22E of the pocket 22. The front surface 22E of the pocket 22 is attached to or integral with the door or flap 26. This configuration allows the pocket 22 to be folded into a substantially flat position inside a compartment or cavity in the greeting card foam core 16 and concealed by the door or flap 26 when the door or flap 26 is in a closed position. When the door or flap 26 is moved to an open position, the pocket 22 is unfolded by direct attachment to or integration with the door or flap 26. In one embodiment, the tab portion 22B of the panel is attached to a slide switch 40. The slide switch 40 includes two contact points 40A, 40B and a slide tongue 40C which is inserted between the two contact points when the switch is in an "off" position, as shown in FIG. 4. When the door or flap 26 is opened, the slide tongue 40C is removed from between the two contact points 40A, 40B, thereby placing the switch 40 in an "on" position, as shown in FIG. 5. In other embodiments, other switch mechanisms may be used.

The electronic components of the combined greeting card and gift card holder 100 are contained within the one or more pockets or compartments in the foam core 16 of the greeting card. These electronic components may include, but are not limited to: a printed circuit board 32, an integrated circuit chip, a memory device containing one or more audio files stored thereon, a speaker 34, a power source 36, a motor 38, a switch 40 and various wires and circuitry which may connect one or more of the electronic components. The electronic components may additionally include any other component which is required to or which facilitates playing the one or more audio files through the speaker 34 and movement of a mobile object 12 by the motor 38, such components being known to one having ordinary skill in the art. A mobile object 12, which in one embodiment, is a die cut shape which is shaped and printed to resemble an eyeball. The die cut eyeball 12 located on the front surface of the greeting card and is connected, either directly or through a connection mechanism to the motor 38 through an opening in the foam core 16 and faux fur 14 and/or the first sheet material 19 attached to the front surface of the foam core 16 of the greeting card. The switch 40 is used to initiate the audio playback and the motor 38, which effects movement of the mobile object 12.

In operation, a user receives the greeting card and may open the sentiment panel 20A, 20B, located on the rear surface of the foam core 16 of the greeting card. As described above, the greeting card sentiment panel 20A, 20B may have text sentiment printed thereon along with other printed matter (photos, drawings, pictures, etc.) and the sentiment panel 20A, 20B may further contain a personally printed or written message from the greeting card giver. The recipient may also open the door or flap 26 on the front surface of the greeting card to reveal the gift card holder 22 therebeneath. As shown in the figures, the door or flap 26 opens by grasping the door or flap 26 by a tab 30 located along a top surface thereof and pulling downward. The gift card holder 22 is revealed upon opening the door or flap 26. As described above, the gift card holder 22 may be an open-sided pocket into which a gift card 24 may be inserted and removed. In other embodiments, the gift card holder 22 may take a different shape or form. Opening the door or flap 26 also moves the slide switch from an "off" position to an "on" position which initiates playback of audio through the speaker 34 and initiates the motor 38 which causes movement of the mobile object 12 attached to the front surface of the greeting card.

While the present disclosure and accompanying figures describe the combined greeting card and gift card holder with respect to a specific embodiment, changes can be made to the this described embodiment while remaining within the scope of the present disclosure and related inventions. The flap or door which provides access to the hidden compartment which contains the gift card holder is described as being located on a front surface of the greeting card, however, the flap or door (and access to the gift card holder) may be contained on an inside or any other surface of the greeting card. The gift card holder is described as having a three-sided open pocket into which a gift card may be inserted and removed, with the open side being along a top edge thereof. However, the open side of the pocket may alternatively be on either side of the pocket. The gift card holder may also alternatively be a sleeve, a closed (but openable) pocket or container, or it make take on alternative forms as long as they fit within the greeting card body beneath the door or flap. Alternatively, the gift card may not be contained within a gift card holder but may be attached directly to an inside surface of the greeting card beneath the door or flap. The mobile object has been described herein and shown in the figures as being a faux eye or round die cut shape, although the mobile object can take on other forms and/or be made of other materials. Additionally, the mobile object is described and shown as being located on a front surface of the greeting card, however it may be located on any other surface thereof. Alternate embodiments may also contain more than one mobile object. The described embodiment contains faux fur on at least one surface thereof, however, other embodiments may contain no faux fur or may be covered, at least partially, with other tactile materials or may contain additional or alternate embellishments. Also, the first and second sheet material that have been described herein as being attached to the front and rear surfaces of the foam core 16, alternate embodiments may not contain this sheet material. The shape and printing and decor of the combined greeting card and gift card holder has been described as resembling a monster, however, other shapes and/or themes may be used. The switch has been described herein and shown in the figures as being a contact switch, however, other switches, including, but not limited to: a slide switch, a push button switch, an on/off switch, a light sensitive switch, a touch sensitive switch, a motion sensitive switch, and a magnetic switch have been contemplated and are considered to be within the scope of the present invention.

The foregoing embodiments of the present invention have been presented for the purposes of illustration and description. These descriptions and embodiments are not intended to be exhaustive or to limit the invention to the precise form disclosed, and obviously, many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

What is claimed is:

1. A combined greeting card and gift card holder comprising:

a greeting card body having one or more cavities therein;

a motor module contained within the one or more cavities of the greeting card body;

a mobile object attached to the greeting card body;

a flap contained on the greeting card body, the flap operative to move between a first or closed position and a second or open position;

a gift card holder contained within the one or more cavities in the greeting card body and beneath the flap;

a switch which controls activation of the motor module, the switch attached to the gift card holder;

wherein opening the flap reveals the gift card holder and activates the motor module causing movement of the mobile object.

2. The combined greeting card and gift card holder of claim 1, further comprising a sound module having at least one audio file contained thereon, the sound module located within the one or more cavities in the greeting card body.

3. The combined greeting card and gift card holder of claim 2, wherein the switch controls activation of the sound module.

4. The combined greeting card and gift card holder of claim 1, further comprising a gift card contained in the gift card holder.

5. The combined greeting card and gift card holder of claim 1, wherein a front surface of the greeting card body is substantially covered by faux fur.

6. The combined greeting card and gift card holder of claim 1, wherein the greeting card body includes a sentiment panel.

7. The combined greeting card and gift car holder of claim 1, wherein the switch is a slide switch.

8. A greeting card comprising:

a greeting card body having one or more hidden compartments therein;

a gift card holder contained within the one or more hidden compartments in the greeting card body;

a flap contained on the greeting card body over the gift card holder;

a sound module contained within the one or more hidden compartments in the greeting card body, the sound module operative to store and playback at least one audio file;

a motor module contained within the one or more hidden compartments in the greeting card body, the motor module operative to cause movement of a mobile object;

wherein opening the flap activates the sound module causing playback of the at least one audio file, activates the motor module causing movement of the mobile object and also reveals the gift card holder.

9. The greeting card of claim 8, wherein the gift card holder is an open sided pocket.

10. The greeting card of claim 8, wherein at least a portion of the greeting card body is covered by faux fur.

11. The greeting card of claim 8, wherein the mobile object is attached to a front surface of the greeting card body.

12. The greeting card of claim 8, wherein the mobile object moves in a circular motion.

13. The greeting card of claim 8, wherein the flap is integral with the greeting card body.

14. The greeting card of claim 8, further comprising a sentiment panel attached to a rear surface of the greeting card body.

15. A combined greeting card and gift card holder comprising:

a greeting card body having one or more hidden compartments therein;

a flap contained on the greeting card body, the flap operative to move between an open position and a closed position;

a gift card holder contained within the one or more hidden compartments in the greeting card body and visible when the flap is in the open position;

a motor module contained within the one or more hidden compartments in the greeting card body;

wherein moving the flap from the closed positon to the open position initiates the motor module causing movement of a mobile object connected to the greeting card body.

16. The combined greeting card and gift card holder of claim 15 further comprising a sound module having at least one audio file stored thereon and being operative to playback the at least one audio file through a speaker.

17. The combined greeting card and gift card holder of claim 16, wherein moving the flap from the closed position to the open position causes playback of the at least one audio file through the speaker.

18. The combined greeting card and gift card holder of claim 16, wherein the flap is located on a front cover of the greeting card.

19. The combined greeting card and gift card holder of claim 16, wherein the mobile object is located on a front cover of the greeting card.

20. The combined greeting card and gift card holder of claim 16, wherein the gift card holder is an open-sided pocket.

* * * * *